United States Patent [19]

Lawrason, Sr.

[11] 4,332,405

[45] Jun. 1, 1982

[54] ADJUSTABLE FRAME FOR SUPPORTING MACRAME

[76] Inventor: Robert E. Lawrason, Sr., 3418 Proctor, Flint, Mich. 48504

[21] Appl. No.: 921,254

[22] Filed: Jul. 3, 1978

[51] Int. Cl.[3] ..... B65H 69/04

[52] U.S. Cl. ..... 289/16.5

[58] Field of Search ..... 289/18 M, 16.5; 211/30, 211/203; 248/177

[56] References Cited

U.S. PATENT DOCUMENTS

| | | | |
|---|---|---|---|
| 3,603,489 | 9/1971 | Fleisher | 211/30 |
| 4,003,592 | 1/1977 | Schreves | 289/18 M |
| 4,029,347 | 6/1977 | Garcia | 289/18 M |
| 4,111,471 | 9/1978 | Hanley | 289/18 M |

*Primary Examiner*—Louis Rimrodt
*Attorney, Agent, or Firm*—Gifford, VanOphem, Sheridan & Sprinkle

[57] ABSTRACT

An adjustable frame structure is provided which is particularly useful for supporting macrame while it is being put together. At least three legs are pivotally and slidably secured at one end to an annular ring. Thus, the legs are easily spread apart from each other and the height of the frame is easily adjustable. Furthermore, since the legs can be easily spread apart, the device enables a chair to be easily placed between the legs and thereby provide a comfortable working position. In addition, a cord and pulley is provided in order to adjust the height of the macrame with respect to the frame.

2 Claims, 3 Drawing Figures

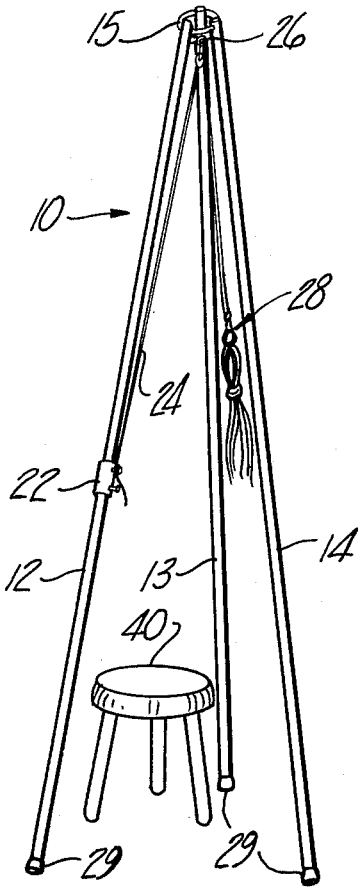
Fig-1
Fig-2
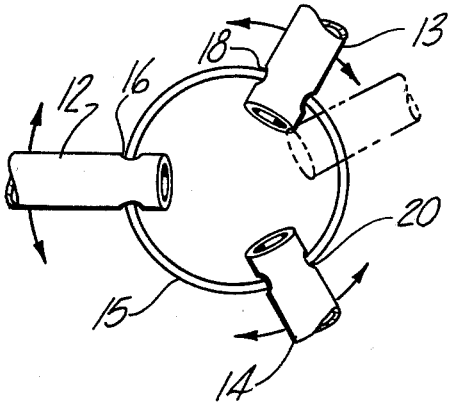
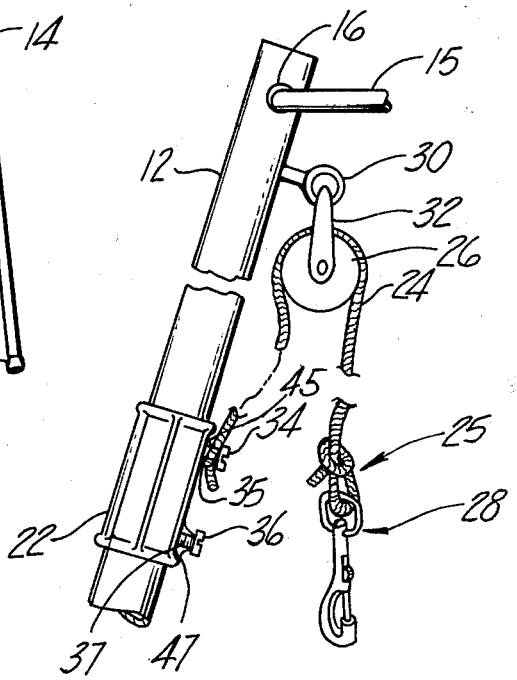
Fig-3

ADJUSTABLE FRAME FOR SUPPORTING MACRAME

BACKGROUND OF THE INVENTION

I. Field of the Invention

The present invention generally relates to adjustable tripods or quadripods and more particularly to such tripods or quadripods having slidably and pivotally secured legs to support macrame work hung therefrom.

II. Description of the Prior Art

Tripods have long been known and used to provide support for objects mounted below the apex of the tripod. Moreover, tripods have previously been used to support objects suspended from the tripod directly below its apex. Although such tripods are often provided with permanently positioned legs, other tripods have been provided with legs that can be pivoted at the apex of the tripod so that a leg may be spread apart from the plane of the other two legs and thereby increase the stance of the tripod. Since tripods are relatively stable structures and can support a substantial amount of weight even pivotal leg tripods must be provided with means to prevent the movement of the legs with respect to each other while a load is applied to the tripod in order to prevent slippage or collapse of the tripod. In addition, it is often desirable to include a fourth leg in the frame to increase stability. Moreover, in order to maintain stability of these previously known load supporting structures, no other displacement of the legs with respect to each other has been provied or even desired.

Such rigidity is disadvantageous in a frame used for making macrame. In order to make a macrame article, strands of yarn or other similar material must be suspended by an elevated bar or frame. Various strands are then tied in a variety of combinations to form a series of knots. As the knots are formed, the length of the macrame article increases accordingly. Consequently, the height at which the knots are being tied continues to decrease. If the article is suspended at a stationary height, the worker must first reach up to and then gradually stoop down towards the area of the article at which the knots are tied.

Since making macrame is often a lengthy project, it is desirable to provide a chair between the legs of the support structure in order to provide a comfortable working position. Tripods with permanently attached or merely pivoting legs can make it difficult to position a chair between the legs and can make access to and egress from the chair difficult.

It is also desirable to be able to adjust the height of the macrame article so that as the length of the article increases, the portion of the article being worked on can be maintained at a comfortable working height. Previously known macrame suspension means often require that the worker move from the comfortable working position in order to reach and adjust the suspended support means. Although a pulley and depending cord arrangement have been used to suspend articles from a tripod, it has not been previously known to adjust height of the depending cord by securing the other end of the cord at a variety of positions along the length of one of the legs of the tripod. Furthermore, when a tripod with permanently positioned or merely pivotal legs is used, such a cord fastening means would still require that the worker move from the comfortable working position in order to adjust the height of the depending cord.

SUMMARY OF THE INVENTION

The present invention obviates the above-mentioned disadvantages by providing a tripod or quadripod frame having legs which are slidably and pivotally displaceable with respect to each other and also having an adjustable depending, suspension means secured to one leg of the tripod. The legs of the frame are slidably mounted on an annular ring and can pivot around the body of the ring. Thus, when it is desirable, as in making macrame, to provide a chair between the legs of the tripod so as to provide a comfortable working position near the suspended macrame article, the legs can be pivoted outward to adjust the height of the tripod and the legs can be slid around the ring to thereby increase the distance between any two legs. Thus, a chair can be placed between any pair of legs which are positioned sufficiently far apart to permit easy access and egress from the chair. Once a worker has assumed a comfortable position in the chair, one of the adjacent legs can be grasped, pivoted outwardly slightly, and slid along the ring toward the chair in order to align the legs in their most stable, equidistantly displaced position. Conversely, when the worker desires to leave the comfortable working position a leg may be grasped, pivoted slightly outwardly, and slid along the ring away from the chair so as to provie adequate space from which to exit without moving the chair or the entire tripod.

Furthermore, a pulley is attached to one leg near the end connected to the annular ring and enables a cord to be drawn over the pulley and depend therefrom so that one end of the cord extends into the middle of the frame. The other end of the cord is fastened to a tube member which is slidably received over the same length. As the tube member is slid along the length of the leg, the height of the suspended end of the cord is adjusted with respect to the tripod. Locking means are provided on the tube member to secure the tube member in a particular position on the leg and thereby maintains the suspended end of the cord at a particular height with respect to the frame. A clasping means such as a hook is fastened to the suspended end of the cord in order to hold the macrame article.

Therefore, the present invention provides an easily operable, height adjustment means so that the height at which the knots are being tied can be maintained at a comfortable working height, such as that height at which a person comfortably seated in a chair would be able to reach. As the length of the macrame article continues to increase, and thereby decreases the height at which the knots are to be added, the tube member may be slid down the leg to thereby increase the height of the suspended end of the cord and therefore the height at which the new knots are to be tied. Since the leg of the tripod is easily grasped and moved by a worker seated in the chair, the height adjusting mechanism of the present invention is easily accessible to the worker while he remains seated.

BRIEF DESCRIPTION OF THE DRAWINGS

FIG. 1 is a perspective view of an adjustable tripod frame of the present invention in a stable working position;

FIG. 2 is a fragmentary top plan view of the adjustable frame of the present invention as shown in FIG. 1;

FIG. 3 is a broken fragmentary side view of the height adjusting and anchoring means for an adjustable tripod frame of the present invention.

DETAILED DESCRIPTION OF THE DRAWINGS

With reference to FIG. 1, the adjustable frame 10 for holding macrame work is thereshown having three legs 12, 13, and 14. Each of the legs has a transverse bore 16, 18, and 20, respectively, at one end thereof which slidably receives an annular ring 15 (see FIG. 2). An anchoring collar 22 is slidably received over the leg 12 and has one end of a cord 24 fastened thereto. The cord 24 extends up along the leg 12 and is received in a grooved rim of a pulley 26 which is secured near the top of the leg 12 in a manner to be described hereinafter. The other end 25 of the cord 24 extends downwardly from the pulley 26 and has a macrame holding or clasping means 28 attached thereto.

The legs 12, 13, and 14 are preferably made of a strong but lightweight tubing. However, it is obvious that the legs can be made of metal or plastic tubing or metal, plastic or wooden rods. The length of each leg is preferably slightly greater than the height of the room in which it is used. Thus, as the legs are spread out at an angle to form a stable structure, the maximum possible height of the clasping means 28 is substantially the same as the height of the room. The end of the leg opposite to the end having the bore hole 16, 18 or 20, in other words, the bottom end, is provided with caps 29 made of rubber or similar material so that the legs may frictionally engage the flooring surface. The annular ring 15 is preferably made of metal but can be constructed of any rigid, smooth material which allows the legs to freely pivot around and slide along the annular ring.

With reference now to FIG. 3, the macrame height adjusting and anchoring means is thereshown. A collar member 22 is slidably received over the leg 12 and slides along the length of the leg. A screw 34 is threadably engaged in a transverse bore 35 within the collar 22. The transverse bore 35 can be formed in the wall of collar 22 but is preferably formed through a radially extending body portion 45 of the collar 22. The screw 34 can be wedged between strands of the cord 24 or the cord 24 may be looped around and tied to the screw 34 so that the cord 24 is securely fastened to the collar 22. A second screw 36 is threadably engaged in a second transverse bore 37 through the collar 22. Similar to bore 35, the bore 37 can be formed through a radially extending body portion 47 of collar 22. As the second screw 36 is threaded into the collar 22, it presses against the leg 12 and thereby locks the collar 22 in its position on the leg 12. Conversely, turning the screw in the other direction loosens the frictional engagement between the collar 22 and the leg 12 and thereby enables the collar to be slid along the length of the leg 12.

A loop member 30 such as an eyebolt is radially extended from the leg 12 at a point slightly below the aperture 16 in which the ring 15 is disposed. The loop member 30 extends toward the inner space of the tripod between the legs 12, 13, and 14. A pulley 26 is suspended from the loop member 30 by any conventional means such as a hook 32. The cord 24 extends from the screw 34 up along the length of the leg 12 and extends over the grooved rim of the pulley 26. Therefore, the other end of cord extends downwardly from the pulley into the center of the tripod. The suspended end 25 of the cord 24 is fastened to the clasping means which can take the form of a closing hook as shown at 28. The macrame strands can then be hung directly from the hook 28 or from a lateral bar (not shown) which is adapted to be held by the clasping means 28.

The frame of the present invention is easily adjustable in order to afford a person making the macrame article a comfortable working position. A seat such as a stool 40, which enables the worker to be comfortably seated while working, can be placed between the legs of the frame. Such a seat is preferably placed between the legs 12 and 13 or the legs 12 and 14 so that the height adjustment collar 22 is easily accessible to the seated worker. When the stool has been placed between the legs of the frame the worker may easily approach and seat himself on the seat 40 by first grasping a leg, pivoting it slightly outwardly, and sliding it around the ring away from the stool and towards another leg. Once the worker is seated, he may again grasp the leg which was moved and slide it back towards the stool 40 so that the frame is in its most stable position.

The sliding collar 22 is originally fastened to the leg 12 at a high point so that the suspended end 25 of the cord 24 is directly in front of the worker in his seated position. As the work continues, the length of the macrame article increases and, therefore, gradually approaches the floor. When the working height of the article becomes too low and therefore uncomfortable, the seated worker can easily reach up and loosen the screw 36 in the collar 22 and then slide the collar 22 downwardly along the length of the leg 12 so that the suspended end 25 of the cord 24 is raised to thereby increase the height of the macrame article. The screw 36 is then tightened against the leg 12 so that the seated worker may resume work in comfortable position. Such a procedure may be continued until the desired length of the macrame article is attained.

When the worker desires to stop working and leave the working area within the frame legs, he may easily grasp one of the legs nearest him, pivot it slightly outwardly and slide it along the ring away from the chair to reposition it nearer one of the other legs. Thus, the space between the two legs adjacent the seat is increased so that the worker may easily swing his legs around the seat, stand up and walk away from the seat and tripod. The frame can remain standing with the legs so positioned that they do not obstruct a substantial portion of the area of the room. Alternatively, the frame can be easily collapsed and stored by sliding and positioning the legs directly adjacent to each other on the ring.

It is to be understood, however, that the present invention is not limited to frames having only three legs but also includes frames having four or more legs.

Having thus described my invention, many modifications thereto will become apparent to those skilled in the art to which it pertains without departing from the spirit and scope of the invention as defined by the appended claims.

What is claimed is:

1. An adjustable frame for supporting macrame comprising:

at least three legs, each having a transverse through bore at one end, an annular ring loosely received in said through bores to hold said one ends of said legs together while at the same time permitting the opposite ends of said legs to be selectively pivoted about said ring to vary the height of said frame and to be selectively circumferentially displaced from one another around the ring whereby each said leg can be simultaneously pivoted and circumferentially displaced or merely pivoted or merely circumferentially displaced, a pulley supported by one of said legs near said ring, support means extending over said pulley and having one end adapted for receiving and supporting the macrame while the macrame is being formed;

means carried by one of said legs and adjustably movable therealong;

an end of said support means opposite said macrame being attached to said adjustable means whereby movement of said adjustment means along said leg varies the position of the macrame.

2. The invention as defined in claim 1 wherein said adjustable means comprises:

a tube member slidably received around said one of said legs and having at least one radially extending portion having a threaded bore therethrough, a screw engaging said threaded bore so that threading of the screw into the hole tightens said tube member against said one of said legs and thereby securely positions said tube member along the length of said leg, and means for fastening said support to said tube member.

* * * * *